US006286427B1

(12) United States Patent
Smith

(10) Patent No.: US 6,286,427 B1
(45) Date of Patent: Sep. 11, 2001

(54) ADAPTOR FILLET FOR PRINTING PRESS CYLINDER AND METHOD OF USING

(75) Inventor: John M. Smith, High Wycombe (GB)

(73) Assignee: Duco International Limited

( * ) Notice: Subject to any disclaimer, the term of this patent is extended or adjusted under 35 U.S.C. 154(b) by 0 days.

(21) Appl. No.: 08/952,065

(22) PCT Filed: May 9, 1996

(86) PCT No.: PCT/GB96/01113

§ 371 Date: Dec. 29, 1997

§ 102(e) Date: Dec. 29, 1997

(87) PCT Pub. No.: WO96/35581

PCT Pub. Date: Nov. 14, 1996

(30) Foreign Application Priority Data

May 10, 1995 (GB) ..... 9509477

(51) Int. Cl.[7] ..... B41F 27/12

(52) U.S. Cl. ..... 101/375; 101/415.1; 101/483

(58) Field of Search ..... 101/415.1, 382.1, 101/378, 389.1, 375, 376, 483; 492/48, 49, 57

(56) References Cited

U.S. PATENT DOCUMENTS 4,403,549 * 9/1983 Matuschke ..... 101/415.1
4,742,769 * 5/1988 Zeller ..... 101/415.1
4,815,380 * 3/1989 Fischer ..... 101/375
4,932,324 * 6/1990 Pinkston et al. ..... 101/415.1

FOREIGN PATENT DOCUMENTS

2096171 * 10/1996 (CA) .

* cited by examiner

*Primary Examiner*—Daniel J. Colilla
*Assistant Examiner*—Lelsie J. Grohusky
(74) *Attorney, Agent, or Firm*—Nixon & Vanderhye P.C.

(57) ABSTRACT

For use in a printing press cylinder (1) of the type having in its surface an axial cavity (2) produced for location of a lock-up device for a printing blanket on the cylinder, there is provided an adaptor fillet to adapt the cylinder for accommodation of a printing blanket without a lock-up device, the adaptor fillet comprising a fillet (3) of a shape for insertion into the cavity so as to bridge the cavity flushly with the cylinder surface periphery, said fillet having an arcuately curved bridge surface (10) of the same radius of curvature as that of the cylinder and having in its bridge surface a longitudinal slit (11) for guidance of a knife edge. In a preferred embodiment of the invention, the fillet is in two-part form, consisting of a lower part (4) securable in the cavity by a threaded fastener entering the cavity base, and an upper part (5) securable to the lower part and providing the arcuately curved bridge surface. The adaptation enables an existing lock-up type printing cylinder to be adapted for non-lock-up securement of a printing blanket without removal of the cylinder form the press, and provides a cylinder surface suitable for application of an adhesive-backed blanket.

17 Claims, 1 Drawing Sheet

ADAPTOR FILLET FOR PRINTING PRESS CYLINDER AND METHOD OF USING

BACKGROUND OF THE INVENTION

1. Field of the Invention

This invention relates to printing press cylinders, particularly to the adaptation of cylinders originally designed for employment with a printing blanket lock-up device to make them suitable for use with adhesively-securable printing blankets.

2. Discussion of the Prior Art

A common means for securing an offset printing blanket onto a press cylinder employs a tensioning 'lock-up' device located within the cylinder body. The device is located in an axially elongate cavity extending into the cylinder body from the cylinder surface. The presence of this device causes a corresponding gap in the usable printing area of the cylinder and furthermore tends to promote undesirable vibration during operation of the printing press, especially at high-speed printing.

Recent developments in printing blankets promote the feasibility of employing a blanket secured to a printing cylinder by adhesive means. New cylinders for such blankets accordingly have a continuous unbroken surface, thereby increasing the usable printing area of the blanket and minimising potential vibration during running of the press.

However, printing cylinders, especially large cylinders of web-feed offset printing presses such as those used in the newspaper and magazine printing industry, are expensive and consequently substitution of a lock-up type of cylinder by a new continuous-surface cylinder is hampered by the entailed cost.

Also, the dismantling and reassembly of a press required for substitution of a printing cylinder is of high concern in the newspaper and magazine printing industry where a long down-time of the press could be highly detrimental to meeting distribution deadlines.

SUMMARY OF THE INVENTION

An object of the present invention is the provision of means for enabling an existing lock-up type printing cylinder to be used with a printing blanket secured by non-lock-up means.

A further object of the invention is the provision of means enabling an existing lock-up type printing cylinder to be adapted for non-lock-up securement of a printing blanket without removal of the cylinder from the press.

A further object of the invention is the provision of means for applying an adhesive-securable printing blanket to a printing cylinder originally designed for lock-up blanket securement.

According to one aspect of the present invention, for use in a printing press cylinder of the type having in its surface an axial cavity produced for location of a lock-up device for a printing blanket on the cylinder, there is provided means to adapt the cylinder for accommodation of a printing blanket without a lock-up device, said means comprising a fillet of shape for insertion into the cavity so as to bridge the cavity flushly with the cylinder surface periphery, said fillet having an arcuately curved bridge surface of the same radius of curvatures as that of the cylinder and having in its bridge surface a longitudinal slit for guidance of a knife edge.

According to the present invention also there is provided a printing press cylinder of the type referred to in the immediately preceding paragraph having, in its surface axial cavity, adapting means as defined in that paragraph.

The fillet should be secured in the cavity rigidly so that it does not loosen under the conditions of operation of the press. Securement may be attained by, for instance, adhesive bonding and/or mechanical securing means. Conveniently, at least some of the bolt-holes originally provided for securement of the lock-up device may be utilised for securement of the fillet.

In a preferred embodiment of the invention, the fillet is in two-part form, consisting of a lower part securable in the cavity by screw-threaded means entering the cavity base, and an upper part securable to the lower part and providing the arcuately curved bridge surface.

A preferred means for securing the upper and lower fillet parts together comprises mechanically interlocking complementary shape formations on the abutting surfaces of the parts. For instance, the top surface of the lower part and the bottom surface of the upper part may have mortise and tenon shape formations to form a dovetail joint.

The shape formation on the top surface of the lower fillet part may be discontinuous, such that there are shape formations for securing to the upper part and holes for accommodating screw-thread attachment to the cavity base positioned alternately along the length of the part. The top ends of the holes may be chamfered or rebated to accommodate the heads of the screw-thread means if desired. The shape formation on the bottom surface of the upper fillet part also may be discontinuous along the length of the part.

Securement of the two-part fillet in the cavity may be achieved by firstly inserting the lower fillet part down into the cavity and securing it therein such as by screw-thread attachment to the cavity base, then locating the upper fillet part on the lower fillet part such that there are alternate upper and lower part shape formations, and then sliding the upper part along the lower part to interlock the shape formations and form a rigid joint between the parts.

In one preferred embodiment, the interlocking shape formations may be longitudinally tapered so that they tighten together when the upper part is slid along the lower part.

A space left in the gap at the end of the upper fillet part may be filled with a correspondingly shaped block which may be secured therein such as by stud means.

A narrow slit is provided longitudinally in the top, bridge, surface of the fillet, for use as a guide channel for a knife edge. Preferably the slit is substantially parallel to the cylinder axis, but optionally it may be at a small angle to that axis. Typically the slit may have a width of the order of 0.5 to 1 mm and a depth of the order of 2 to 5 mm.

A printing blanket may be applied to a cylinder adapted in accordance with the invention from a blanket sheet of length greater than the cylinder circumference by steps comprising: (i) locating the leading end of the blanket sheet along the near edge of the slit or overlapping it; (ii) if necessary, trimming the located leading end of the sheet by running a knife edge along the slit (and removing the trimmed-off portion); (iii) wrapping the blanket sheet around the cylinder by rotating the cylinder as the blanket sheet is fed onto it until the sheet overlaps the slit; (iv) running a knife edge along the slit to produce a blanket trailing end which abuts accurately the leading end with negligible gap between them.

Thus, it is not essential to locate the leading end of a blanket sheet with high precision on the cylinder and it is not necessary to perform a blanket of length equal to the circumference of the cylinder. Moreover, a blanket may be applied to a cylinder without removing the cylinder from the press.

The invention is especially suitable for printing blankets to be secured on the cylinder by means of adhesive.

The adhesive employed for attaching a blanket to the press cylinder must be stable at the temperatures created during high speed running of the printing press and should be resistant to solvents employed for cleaning the blanket.

Preferably the adhesive should be such as to enable removal of a worn or damaged blanket by peeling off the cylinder with no or minimal adhesive residue left on the cylinder surface.

The adhesive layer should be of low thickness and of uniform consistency in order to avoid conferring even small aberrations on the total blanket thickness.

Accordingly, a contact adhesive usually is employed and typically such adhesives have a high initial bond strength which resists adjustment of the position of the blanket after contact with the cylinder. However, other types of adhesive, for instance a settable adhesive (e g heat- or radiation-settable) or a reaction adhesive (e g comprising a pressure-rupturable microencapsulated reactant), may be employed provided that they satisfy the requirements for a printing operations.

The adhesive typically is employed as a pre-coating on the cylinder-side (back) of the blanket and is protected by a releasable sheet of flexible material such as paper or plastics film until immediately prior to application of the blanket to the cylinder. The protective sheet suitably is removed from the blanket continuously as the blanket is fed onto the cylinder. This may be done manually or by a separator blade and the released sheet may be collected in a bin or by winding on a roller.

Preferably the blanket is pressed onto the cylinder during its application in order to ensure good bonding contact and to prevent trapping of air between the blanket and the cylinder.

If desired, the blanket may be pressed onto the cylinder manually, such as by moving a roller under pressure over the blanket on the cylinder continuously from the line of initial contact.

However, a preferred pressure means comprises a dedicated pressure roller or a pressure slide (skid), mounted with its longitudinal axis parallel to that of the cylinder and at a set distance from the cylinder surface. The maximum distance of the pressure roller or slide surface form the cylinder surface should not be greater than the thickness of the blanket being applied and may be adjustably set to apply a predetermined pressure on the blanket.

The pressure slide may have a curved surface, to facilitate smooth sliding of the blanket over the slide surface. The pressure means may be mounted to be guided towards and away from the cylinder as required.

If desired, the leading end portion of the blanket may be located on the pressure means, such as by use of a relatively weak adhesive (e g double-sided adhesive tape), prior to mounting the pressure means at its pressure distance from the cylinder. The pressure means is then moved to its pressure distance with the leading end portion of the blanket between the pressure means and the cylinder. Such a procedure may be useful for reducing the risk of operator contact with the adhesive backing on the blanket since the protective sheet may be released from the leading end portion of the blanket more easily while the end portion is supported on the pressure means. The weak adhesive employed to locate the blanket end portion on the pressure means should be capable of releasing the blanket from the pressure means when the cylinder is subsequently rotated during feeding of the blanket onto the cylinder.

If desired, two or more blankets may be applied to the cylinder, one on top of the other or one after the other in line.

The present invention may be advantageously employed in conjunction with the invention described in our co-pending patent application filed on even date entitled 'Manipulation Of Printing Blankets'.

BRIEF DESCRIPTION OF THE DRAWINGS

The present invention is illustrated, by way of example only, in the accompanying drawings.

DETAILED DISCUSSION OF PREFERRED EMBODIMENTS

Figure 1:
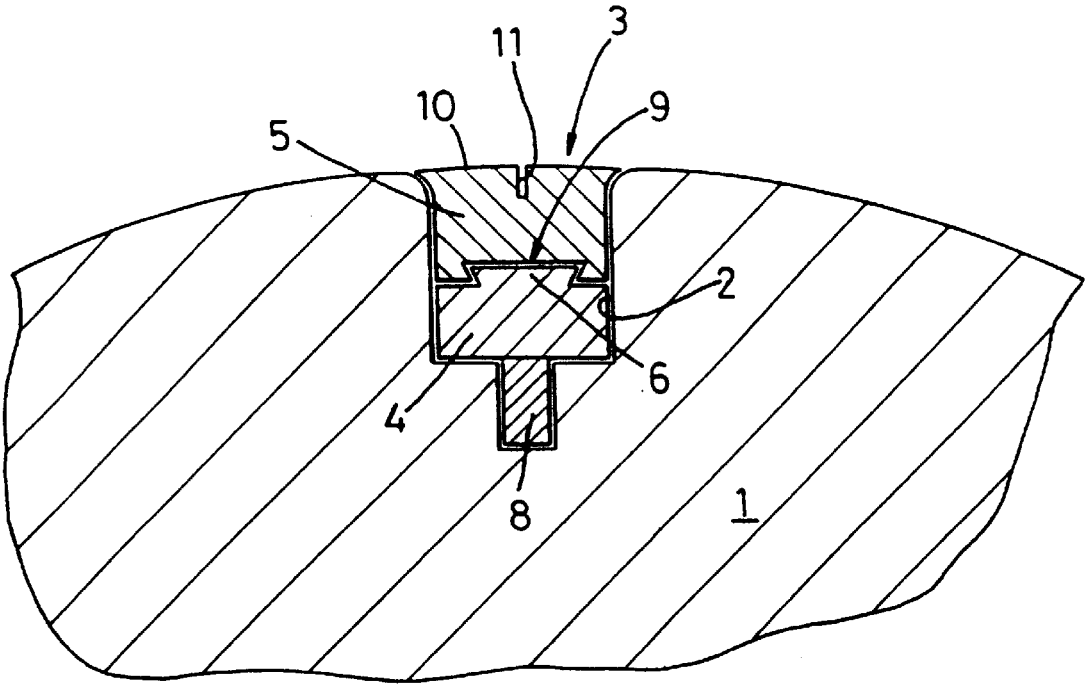
FIG. 1 shows, schematically in radial section, one form of a fillet in accordance with the invention fitted into a redundant lock-up device cavity in a printing press cylinder.

In FIG. 1 there is shown part of a large printing press cylinder 1 having an axially elongate cavity 2 originally used for accommodation of a blanket-tensioning lock-up device and now containing a two-part fillet 3 consisting of a lower part 4 and an upper part 5 shaped to fill the cavity 2.

Figure 2:
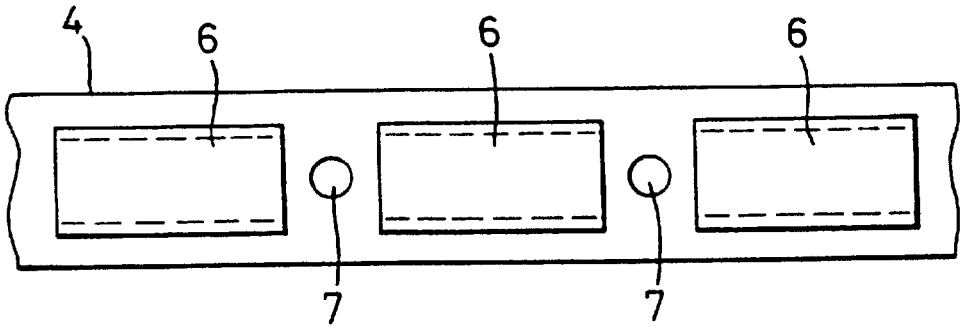
FIG. 2 shows a plan view of a segment of the lower part of the two-part fillet shown in FIG. 1.

With reference to FIGS. 1 and 2, the lower fillet part 4 has a series of dovetail tenon shape formations 6 on its top surface alternating with a series of through-holes 7 for accommodating the shafts 8 of bolt means in bolt holes originally provided in the cylinder for securement of a lock-up device.

The upper fillet part 5 has on its bottom surface a series of complementary dovetail mortise shape formations 9 fitted on the tenon shape formations 6 of the lower part 4. The top surface 10 of the upper part 5 is radiussed to provide continuity of the curvature of the cylinder surface, and contains a narrow elongate axial slit 11 for guidance of a knife edge (not shown).

The upper part 5 may be interlocked on the lower part 4 by locating the parts with their shape formations alternating with each other and then sliding the upper part on the lower part to mate the complementary shape formations.

What is claimed is:

1. An adaptor fillet for use in a printing press cylinder having in its surface an axial cavity produced for location of a lock-up device for a printing blanket on the cylinder, to adapt said cylinder to use a printing blanket without a lock-up device, said fillet comprising a shape for insertion into the cavity so as to bridge the cavity flushly with the cylinder surface periphery, said fillet including an arcuately curved bridge surface of the same radius of curvature as that of the cylinder, wherein said bridge surface includes a longitudinal slit for guidance of a knife edge.

2. An adaptor fillet according to claim 1, wherein the slit is substantially parallel to the cylinder axis.

3. An adaptor fillet according to claim 1, wherein the fillet is in two-part form consisting of a lower part securable in the cavity and an upper part abutting and securable to the lower part and providing the arcuately curved bridge surface.

4. An adaptor fillet according to claim 3, wherein the lower fillet part is securable in the cavity by at least one threaded fastener entering the cavity base.

5. An adaptor fillet according to claim 3, wherein the upper and lower fillet parts are securable together by means comprising mechanically interlocking complementary shape formations on the abutting surfaces of the parts.

6. An adaptor fillet according to claim 5, wherein the complementary shape formations comprise mortise and tenon shape formations to form a dovetail joint.

7. An adaptor fillet according to claim 5, wherein the shape formation on the top surface of the lower fillet part is discontinuous such that there are shape formations for securing the upper fillet part and holes for accommodating screw-thread attachment means to the cavity base positioned alternately along the length of the part.

8. An adaptor fillet according to claim 7, wherein the top ends of the holes are chamfered or rebated to accommodate the heads of the screw-thread attachment means.

9. An adaptor fillet according to claim 5, wherein the complementary shape formations on both fillet parts are discontinuous, whereby, after securement of the lower fillet part in the cavity, the upper fillet part can be secured to the lower fillet part by locating the upper fillet part on the lower fillet part such that there are alternate upper and lower part shape formations and then sliding the upper part along the lower part to interlock the shape formations.

10. Printing press cylinder and an adaptor fillet according to claim 7, wherein the fillet is secured in the cavity using at least some bolt-holes that were originally provided for securement of the lock-up device.

11. Method of applying a printing blanket to a printing press cylinder with an adaptor fillet according to claim 1, comprising providing a printing blanket sheet of length greater than the cylinder circumference, locating the leading end of the blanket sheet along the near edge of the slit or overlapping it, wrapping the blanket sheet around the cylinder by rotating the cylinder as the blanket sheet is fed onto it until the sheet overlaps the slit, and running a knife edge along the slit to provide a blanket trailing end which abuts accurately the leading end with negligible gap between them.

12. Method according to claim 11, wherein the printing blanket sheet is secured to the cylinder by means of adhesive.

13. Method according to claim 12, wherein the printing blanket sheet has an adhesive coating protected by a releasable sheet of flexible material which is removed from the sheet as the sheet is fed onto the cylinder.

14. Method according to claim 11, wherein the blanket sheet is pressed on the cylinder to eliminate entrapment of air between the blanket sheet and the cylinder.

15. Method according to claim 14, wherein the blanket sheet is pressed on the cylinder by pressure means comprising a dedicated pressure roller or pressure slide mounted with its longitudinal axis parallel to that of the cylinder.

16. Method according to claim 15, wherein the pressure mean is mounted to apply pressure at or immediately after the line of initial contact of the blanket sheet with the cylinder.

17. Method according to claim 15, wherein the leading end portion of the blanket sheet is located on the pressure means by a relatively weak adhesive prior to mounting the pressure means at its pressure distance from the cylinder, the pressure means is moved to its pressure distance with the leading end portion between the pressure means and the cylinder, and the weak adhesive releases its hold on the blanket sheet when the cylinder is rotated during feeding of the blanket sheet onto the cylinder.

* * * * *